US008021079B1

(12) United States Patent
Rackham

(10) Patent No.: US 8,021,079 B1
(45) Date of Patent: Sep. 20, 2011

(54) COMPACTOR DEVICE FOR HYDRAULIC HAMMER

(76) Inventor: Alan S. Rackham, Foresthill, CA (US)

( * ) Notice: Subject to any disclaimer, the term of this patent is extended or adjusted under 35 U.S.C. 154(b) by 124 days.

(21) Appl. No.: 12/362,408

(22) Filed: Jan. 29, 2009

(51) Int. Cl.
*E01C 19/34* (2006.01)
*E01C 19/30* (2006.01)

(52) U.S. Cl. ..... 404/133.2; 404/133.05

(58) Field of Classification Search ..... 404/133.2, 404/133.05; 279/16–18, 55, 66; 173/90, 173/124, 29, 113, 132
See application file for complete search history.

(56) References Cited

U.S. PATENT DOCUMENTS 418,604 A * 12/1889 Christie ..... 279/55
769,943 A * 9/1904 Embleton ..... 425/469
2,474,633 A * 6/1949 Marshall ..... 279/66
2,991,085 A * 7/1961 Lyon ..... 279/16
3,277,801 A * 10/1966 Horvath et al. ..... 404/133.1
3,308,730 A 3/1967 Vorwald
3,376,799 A 4/1968 Perry
3,863,857 A * 2/1975 Smith ..... 242/571.1
4,113,403 A * 9/1978 Tertinek et al. ..... 404/113
4,601,352 A 7/1986 Hamilton
4,607,980 A * 8/1986 Shilkov et al. ..... 404/133.05
5,217,320 A 6/1993 Cioffi
5,332,047 A * 7/1994 Hignite ..... 173/1
5,340,233 A * 8/1994 Motl ..... 404/133.05
5,768,785 A * 6/1998 Pessin ..... 30/164.6
D473,113 S 4/2003 Gelb et al.
6,558,073 B1 * 5/2003 Wrazidlo ..... 404/133.05
2007/0295520 A1 12/2007 Comarmond

* cited by examiner

*Primary Examiner* — Thomas Will
*Assistant Examiner* — Abigail A Risic

(57) ABSTRACT

A compactor device for attaching to a shaft of a hydraulic hammer or the like comprising a base, an outer receiving tube and inner receiving component attached to the top of the base, wherein the inner receiving component is for clamping onto the shaft of the hydraulic hammer. The compactor device is for compacting all materials, such as dirt, sand, and/or aggregate material.

5 Claims, 7 Drawing Sheets

COMPACTOR DEVICE FOR HYDRAULIC HAMMER

FIELD OF THE INVENTION

The present invention is directed to a compacting device for attaching to a hydraulic hammer. More particularly, the present invention is directed to a compacting device for compacting any material such as sand, dirt, aggregate material, the like, or a combination thereof.

BACKGROUND OF THE INVENTION

Hydraulic hammers are used for breaking up materials such as concrete, asphalt, rocks, clay, and dirt. Compactors (e.g., tampers) are used for compacting those materials. Compactors are well known in the art, but current models cannot compact all materials. For example, wheel compactors are for compacting dirt only, not sand or aggregate material. Hydraulic vibratory plates are for compacting sand and aggregate materials, not dirt.

The present invention features a compactor device for compacting a material such as dirt, sand, aggregate material, the like, or a combination thereof. The compacting device can be attached to a hydraulic hammer allowing a user to temporarily convert a hydraulic hammer into a compactor. The compactor device of the present invention may be constructed in a variety of sizes so as to accommodate a user's need. For example, a 4 inch plate can be used for a 4 inch trench, a 36 inch plate can be used for a 36 inch trench, and so forth. The compactor device of the present invention may allow a user to temporarily convert a jackhammer into a device for compacting all types of materials.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
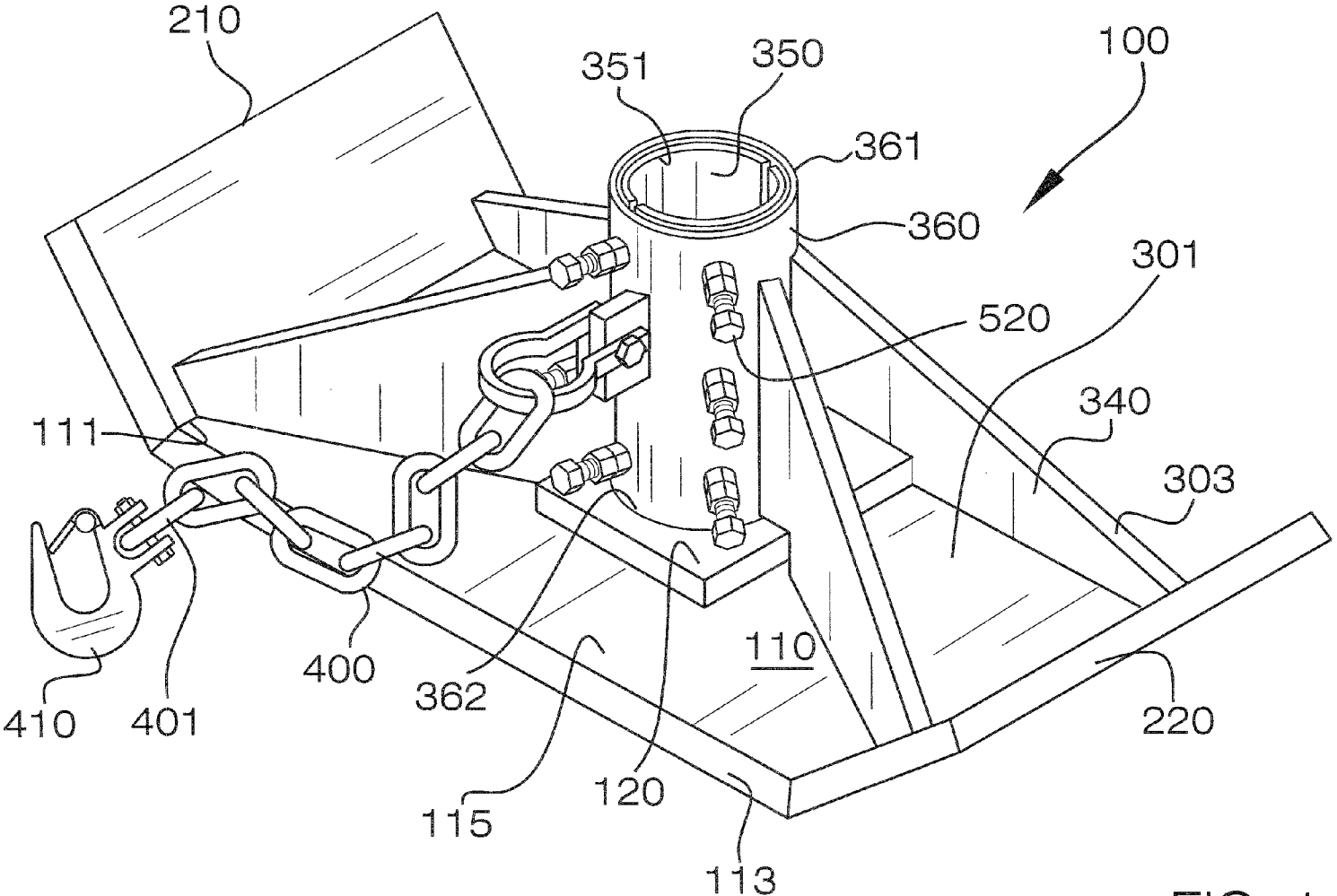
FIG. 1 is a perspective view of the compacting device of the present invention.
Figure 2:
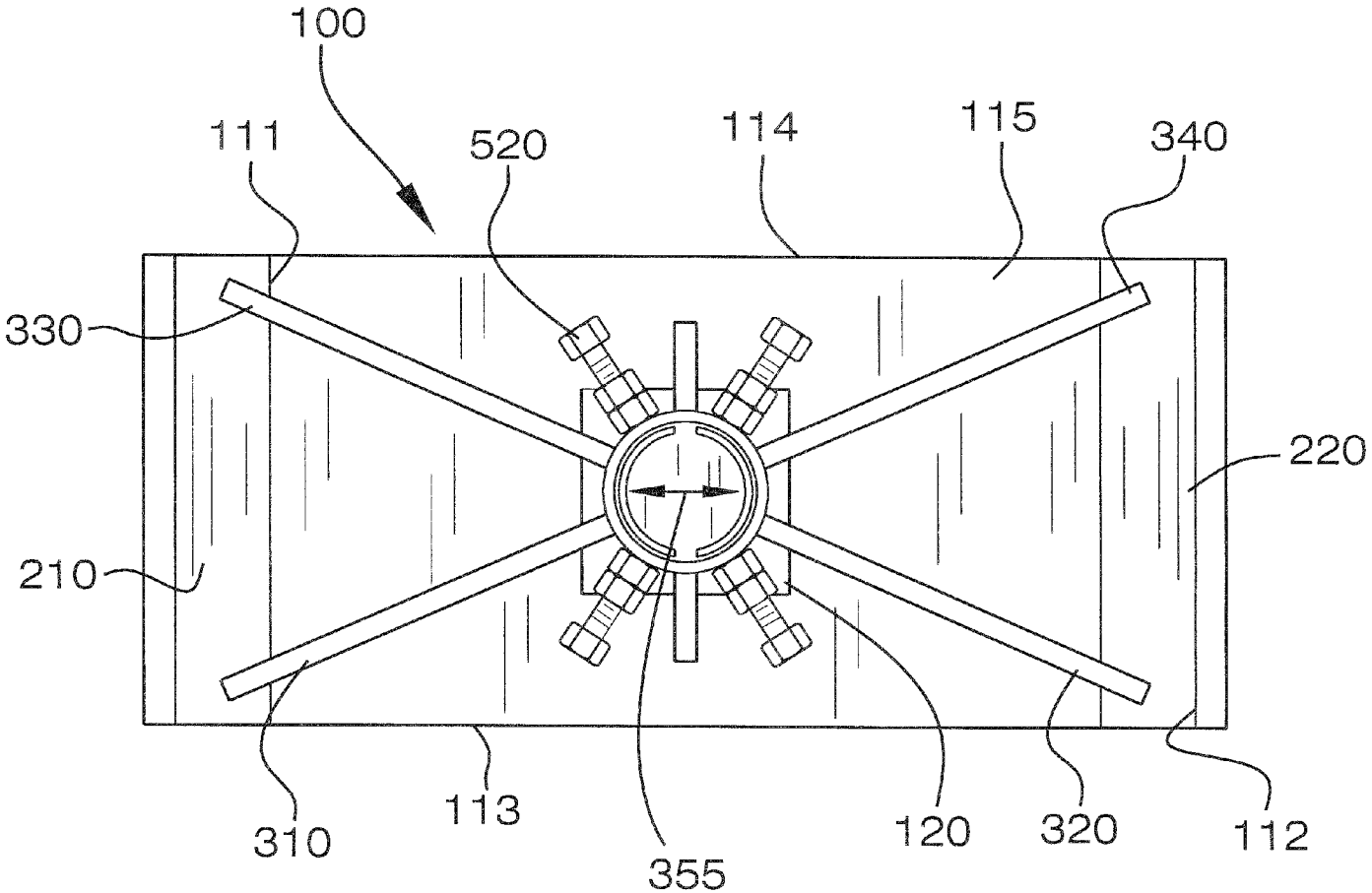
FIG. 2 is a top view of the compacting device of the present invention.
Figure 3:
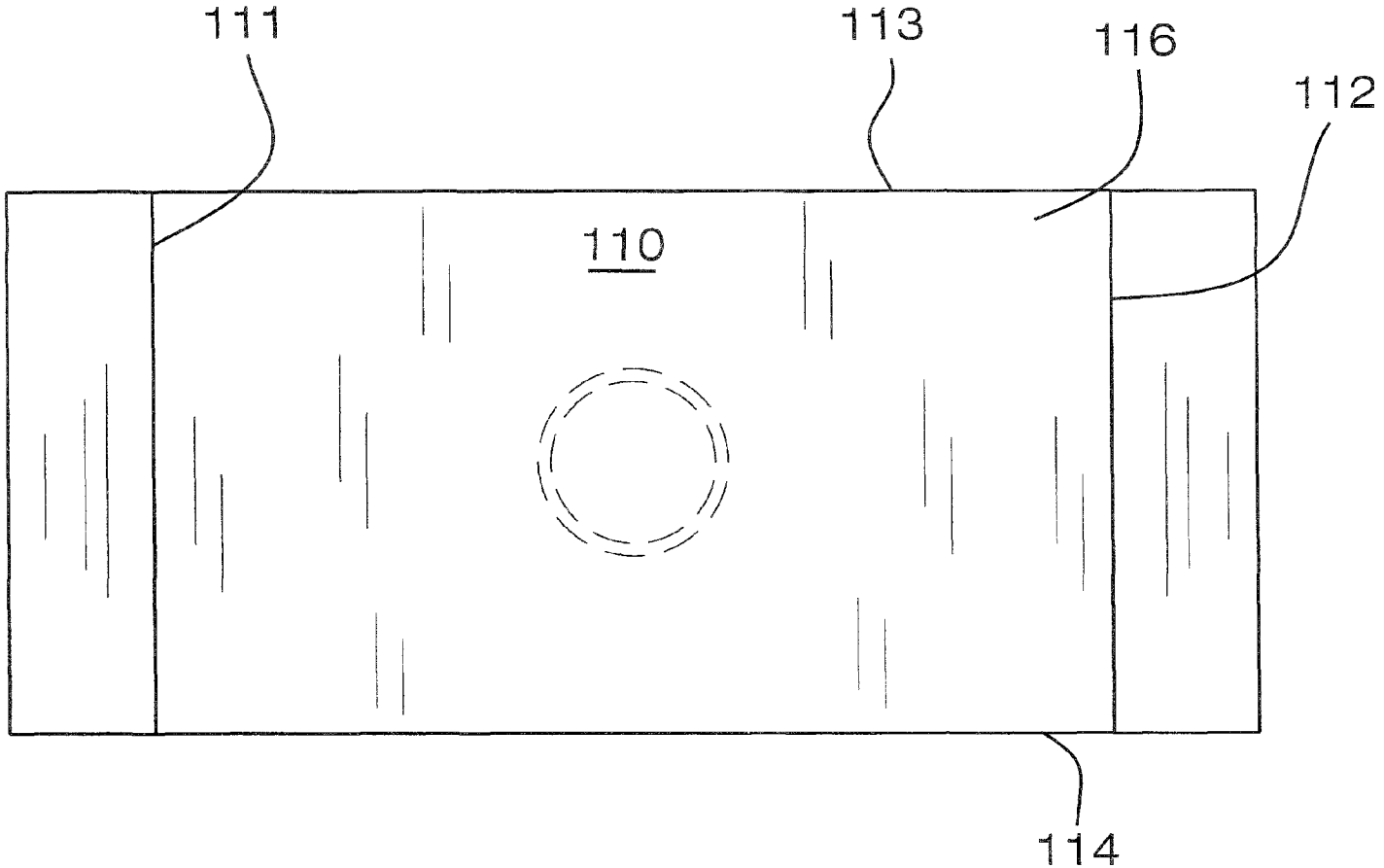
FIG. 3 is a bottom view of the compacting device of the present invention.
Figure 4:
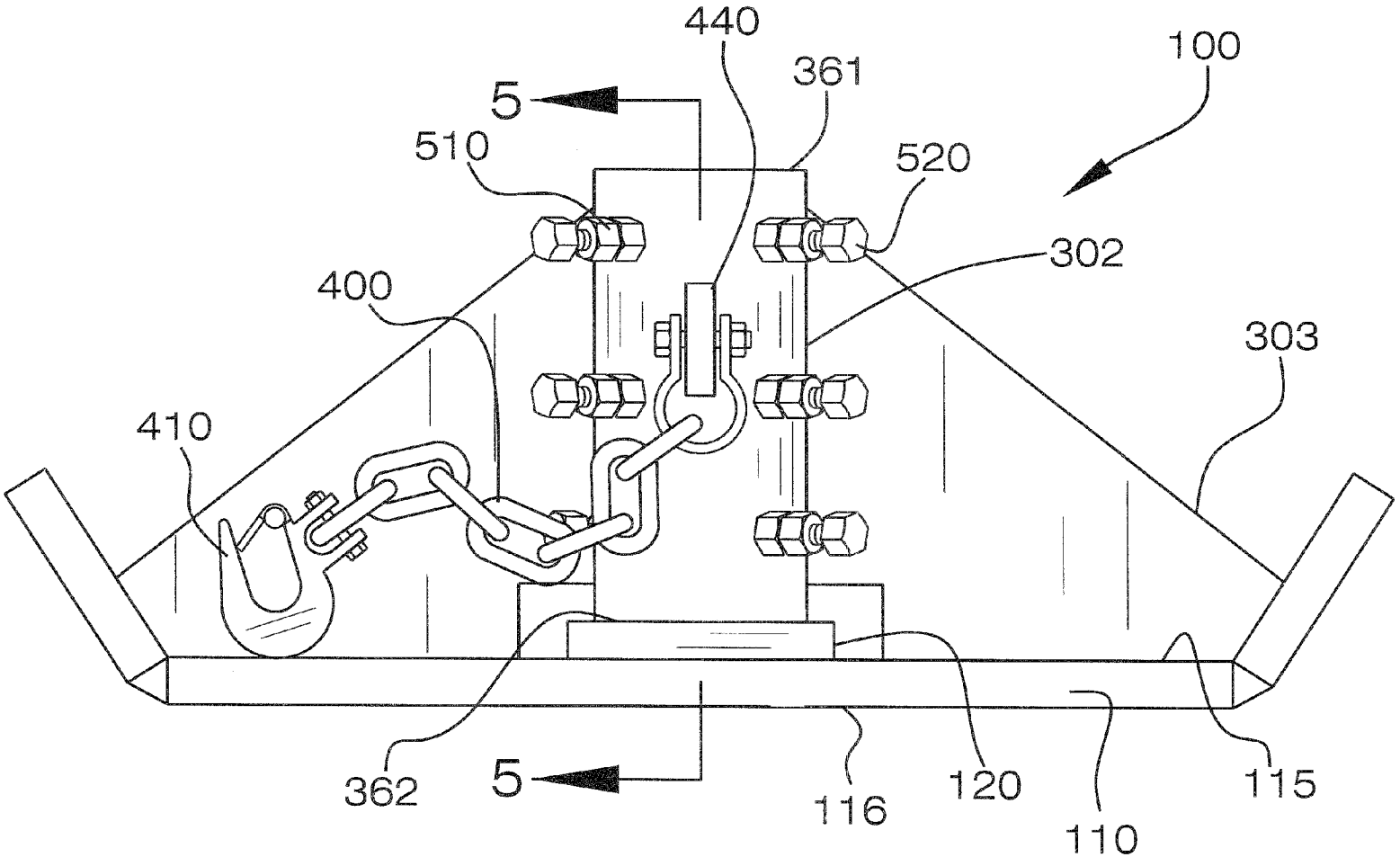
FIG. 4 is a side view of the compacting device of the present invention.
Figure 5:
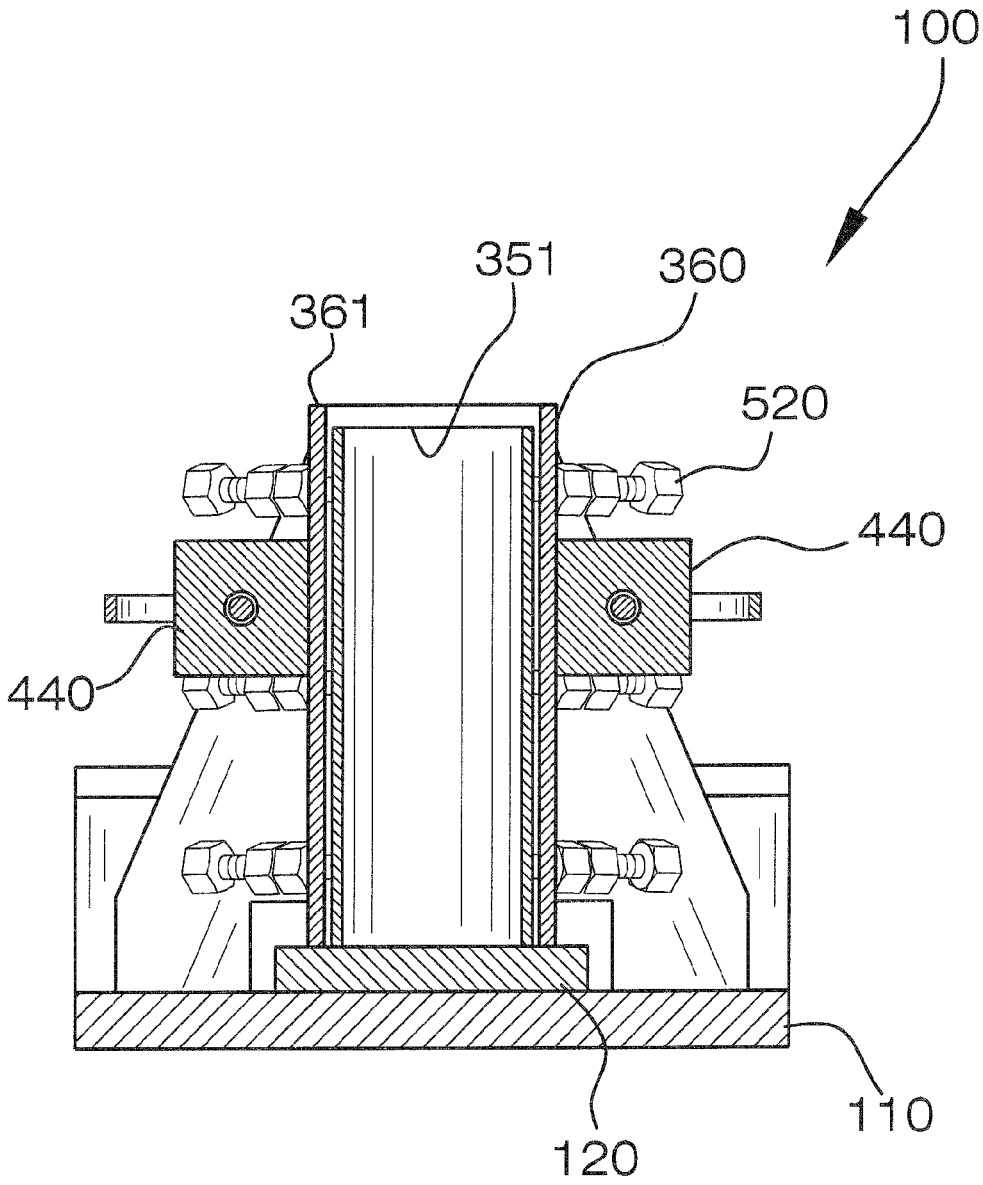
FIG. 5 is a side cross sectional view of the compacting device of the present invention.

The following is a listing of numbers corresponding to a particular element refer to herein:

100 compacting device
110 base

111 first side edge of base
112 second side edge of base
113 third side edge of base
114 fourth side edge of base
115 top surface of base
116 bottom surface of base
120 reinforcing plate
150 hydraulic hammer
155 D-ring
160 shaft
210 first wall of base
220 second wall of base
300 mounting component
301 first side of cross support component
302 second side of cross support component
303 hypotenuse side of cross support component
310 first cross support component
320 second cross support component
330 third cross support component
340 fourth cross support component
350 inner receiving component
351 first end of inner receiving component
352 second end of inner receiving component
353 first half-pipe of inner receiving component
354 second half-pipe of inner receiving component
355 diameter of inner receiving component
360 outer receiving tube
361 first end of outer receiving tube
362 second end of outer receiving tube
400 chain
401 first end of chain
402 second end of chain
410 safety hook
440 attachment means
510 cinch nut or tube nut
520 bolt Referring now to FIG. 1-5, the present invention features a compactor device 100 for compacting a material such as dirt, sand, aggregate material, the like, or a combination thereof. The compacting device 100 can be temporarily attached to a hydraulic hammer 150 allowing a user to convert the hydraulic hammer 150 (e.g., jackhammer) into a compactor. The use of the compacting device 100 is not limited to use with a hydraulic hammer 150. Without wishing to limit the present invention to any theory or mechanism, it is believed that the compactor device 100 of the present invention can allow a user to compact any type of material.

The compactor device 100 of the present invention comprises a generally flat base 110. In some embodiments, the base 110 has a first side edge 111, a second side edge 112, a third side edge 113, a fourth side edge 114, a top surface 115, and a bottom surface 116.

In some embodiments, a first wall 210 is disposed on the first side edge 111 of the base 110. In some embodiments, a second wall 220 is disposed on the second side edge 112 of the base. In some embodiments, a third wall is disposed on the third side edge 113 of the base 110. In some embodiments, a fourth wall is disposed on the fourth side edge 114 of the base 110.

In some embodiments, the walls are for preventing material from accumulating on the top surface 115 of the base 110. Each of the walls extend outwardly and upwardly from the respective edges to which they are attached. In some embodiments, the first wall 210 and/or second wall 220 and/or third wall and/or fourth wall extend outwardly from the respective edge to which it is attached at an angle with respect to the ground surface. In some embodiments, the angle is between about 5 to 15 degrees. In some embodiments, the angle is between about 15 to 30 degrees. In some embodiments, the angle is between about 30 to 45 degrees. In some embodiments, the angle is between about 45 to 60 degrees. In some embodiments, the angle is between about 60 to 75 degrees. In some embodiments, the angle is between about 75 to 90 degrees. In some embodiments, the angle is more than about 90 degrees.

As used herein, the term "about" refers to plus or minus 10% of the referenced number. For example, an embodiment wherein the angle is about 90 degrees includes an angle that is between 81 and 99 degrees.

Disposed on the top surface 115 of the base 110 is a reinforcing plate 120 having a top surface and a bottom surface, wherein the bottom surface of the reinforcing plate is attached to the top surface 115 of the base 110.

An outer receiving tube 360 having a first end 361 and a second end 362 is attached to the top surface of the reinforcing plate 120. Removably disposed on the top surface of the reinforcing plate 120 and inside the outer receiving tube 360 is an inner receiving component 350 that is formed from a first half-pipe 353 and a second half-pipe 354. The inner receiving component 350 has a first end 351 and a second end 352. The diameter 355 of the inner receiving component 350 can be increased or decreased. For example, the first half-pipe 353 and the second half-pipe 354 can be moved farther apart or closer together. The inner receiving component 350 is for receiving a shaft 160 (e.g., bit shaft) of a machine such as a hydraulic hammer 150. The inner receiving component 350 can be fit snugly around the shaft 160.

To secure the compacting device 100 to the shaft 160 when inserted into the inner receiving component 350, a bolt 520 rotatably disposed in the outer receiving tube 360 can be turned in a first direction (e.g., clockwise direction). In some embodiments, a plurality of bolts 520 is disposed in the outer receiving tube 360. Turning the bolt 360 puts pressure on the inner receiving component, which causes the first half-pipe 353 and second half-pipe 354 to be moved closer together. The pressure on the inner receiving component 350 helps to keep the shaft 160 snug inside the inner receiving component 350. When the bolt 520 is turned in a second direction, the pressure is relieved from the inner receiving component 350, which allows a user to remove the shaft 160 from inside the inner receiving component 350. In some embodiments, the bolt 520 is threaded through a hole disposed in the outer receiving tube 360. In some embodiments, a tube nut 510 overlays the hole. In some embodiments, a cinch nut 510 overlays the tube nut 510.

In some embodiments, the compacting device 100 of the present invention further comprises one or more cross support components for providing support to the device 100. For example, in some embodiments, a first cross support component 310 connects the outer receiving tube 360 and the first side edge 111 (e.g., near the intersection of the first side edge 111 and the third side edge 113) of the base 110. In some embodiments, a second cross support component 320 connects the outer receiving tube 360 and the second side edge 112 (e.g., near the intersection of the second side edge 112 and the third side edge 113) of the base 110. In some embodiments, a third cross support component 330 connects the outer receiving tube 360 and the first side edge 111 (e.g., near the intersection of the first side edge 111 and the fourth side edge 114) of the base 110. In some embodiments, a fourth cross support component 340 connects the outer receiving tube 360 and the second side edge 112 (e.g., near the intersection of the second side edge 112 and the fourth side edge 114) of the base 110.

In some embodiments, the cross support components are generally triangular in shape. In some embodiments, the cross support components each have a first side 301, a second side 302, and a hypotenuse side 303, wherein the first side is attached to the top surface 115 of the base 110 and the second side is attached to the outer receiving tube 360.

Figure 6:
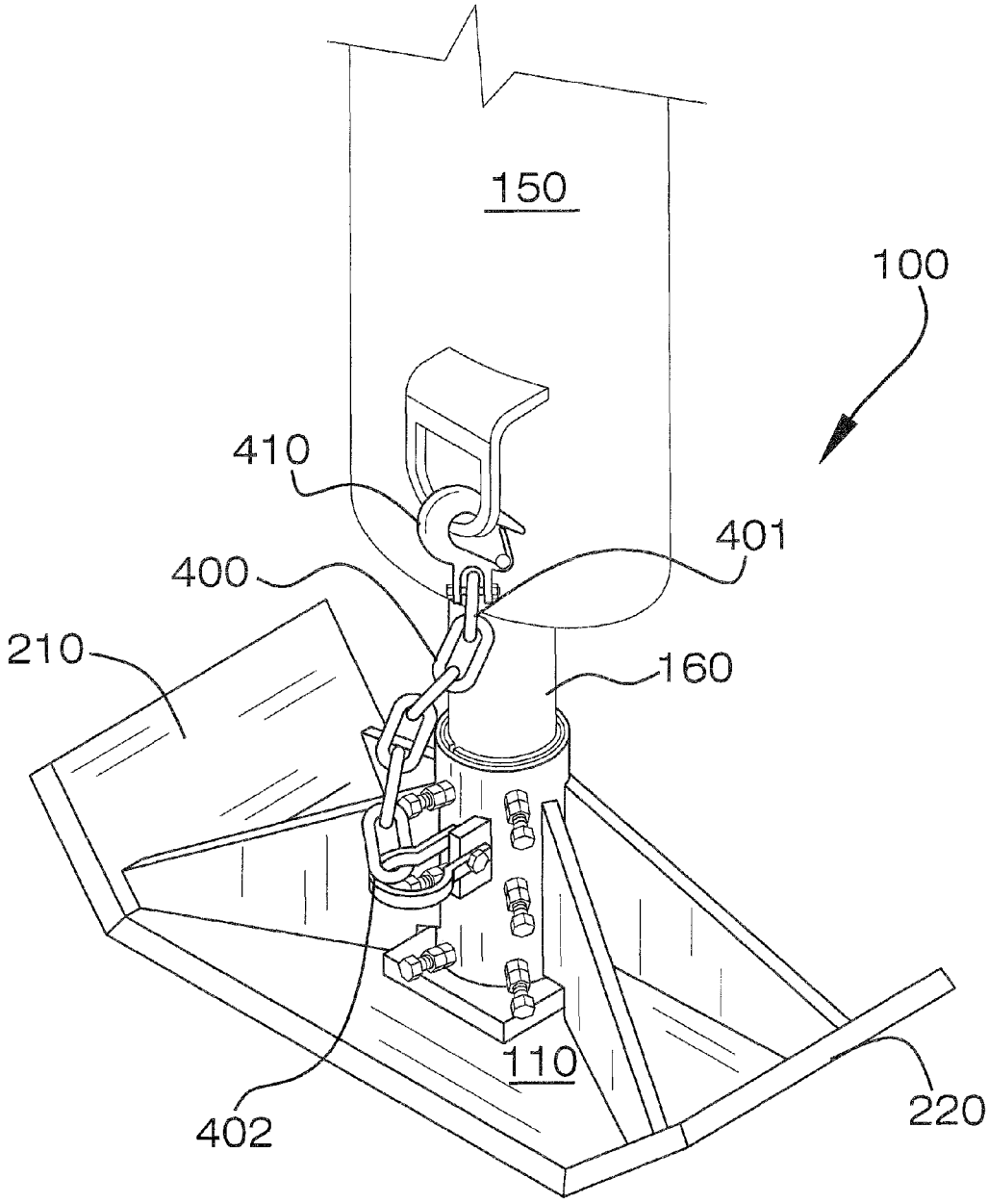
FIG. 6 is a perspective view of the compacting device of the present invention, wherein the compacting device is attached to a shaft of a hydraulic hammer.
Figure 7:
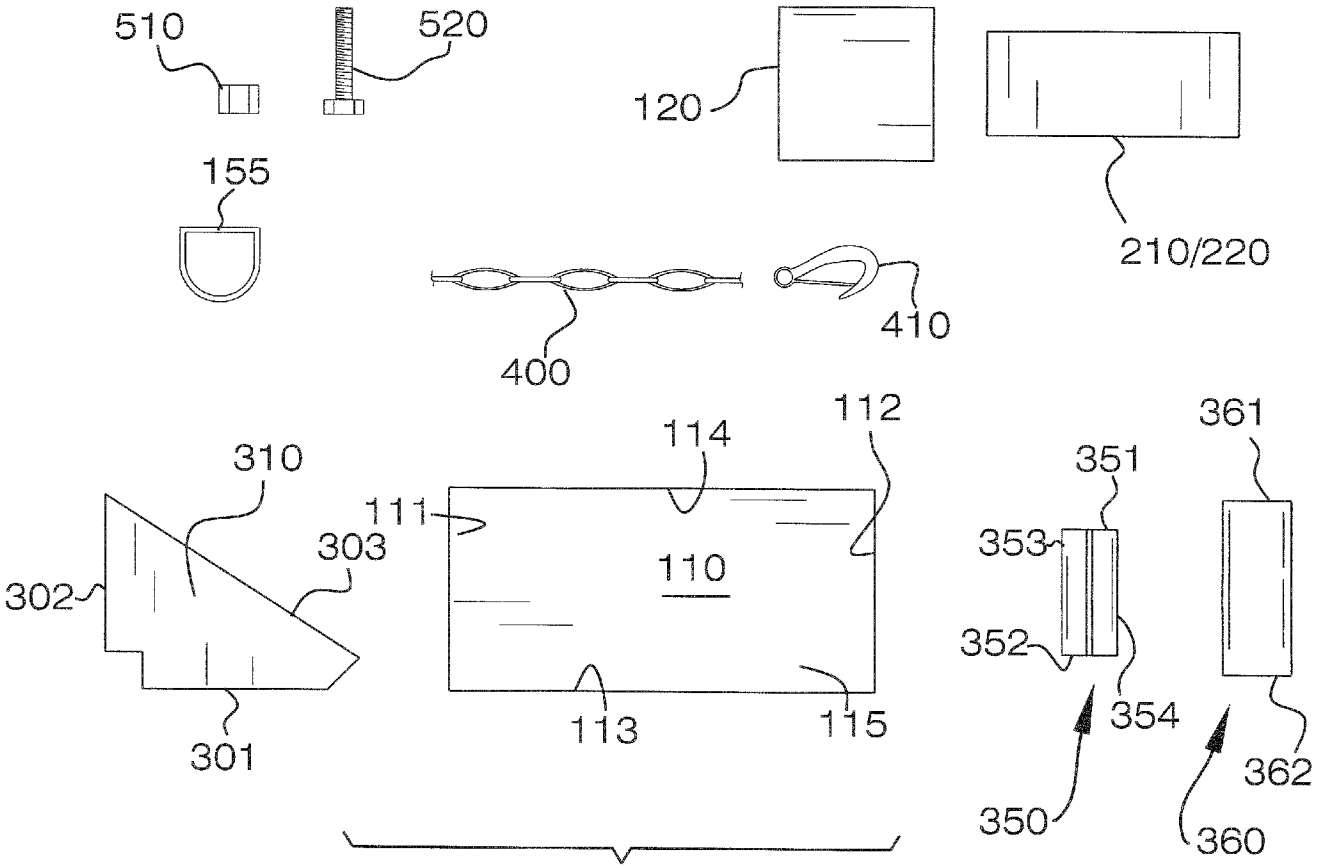
FIG. 7 is an exploded view of the components of the compacting device of the present invention.

In some embodiments, a chain 400 having a first end 401 and a second end 402 is used secure the compacting device 100 to the hydraulic hammer 150. The second end 402 of the chain 400 is secured to the outer receiving tube 360 via an attachment means 440. In some embodiments, the attachment means includes a hook, an anchor, a bolt, the like, or a combination thereof. A safety hook 410 is disposed on the first end 401 of the chain 400. The safety hook 410 is for clipping into a D-ring 155 on the hydraulic hammer 150 (see FIG. 6). While use of the chain 400 is not necessarily required, it can provide an additional connection between the hydraulic hammer 150 and the compacting device 100 in the event that the shaft 160 loosens from within the inner receiving component 350.

Without wishing to limit the present invention to any theory or mechanism, it is believed that the walls (e.g., first wall 210, second wall 220) are advantageous because they help to prevent loose material from collecting on the top surface 115 of the base 110. The walls can also push material out of the way (e.g., similar to a snow plow) to help obtain uniform surfaces. It is also believed that when the walls are at about a 45 degree angle with respect to the base 110, the downward forces are spread out evenly on the bottom surface 116 of the base 110 providing a smoother compacted surface and an increased level of compaction of the material.

The compactor device 100 of the present invention may be constructed in a variety of sizes so as to accommodate a user's need. For example, a 4 inch base can be used for a 4 inch trench, an 18 inch base can be used for an 18 inch trench, a 36 inch base can be used for a 36 inch trench, and so forth.

In some embodiments, the base 110 is between about 4 to 12 inches in length as measured from the first side edge 111 to the second side edge 112. In some embodiments, the base 110 is between about 1 to 2 feet in length as measured from the first side edge 111 to the second side edge 112. In some embodiments, the base 110 is between about 2 to 3 feet in length as measured from the first side edge 111 to the second side edge 112. In some embodiments, the base 110 is between about 3 to 4 feet in length as measured from the first side edge 111 to the second side edge 112.

In some embodiments, the base 110 is between about 14 to 12 inches in width as measured from the third side edge 113 to the fourth side edge 114. In some embodiments, the base 110 is between about 1 to 2 feet in width as measured from the third side edge 113 to the fourth side edge 114. In some embodiments, the base 110 is between about 2 to 3 feet in width as measured from the third side edge 113 to the fourth side edge 114. In some embodiments, the base 110 is between about 3 to 4 feet in width as measured from the third side edge 113 to the fourth side edge 114.

In some embodiments, the outer receiving tube 360 is between about 4 to 6 inches in length as measured from the first end 361 to the second end 362. In some embodiments, the outer receiving tube 360 is between about 6 to 12 inches in length as measured from the first end 361 to the second end 362. In some embodiments, the outer receiving tube 360 is between about 12 to 18 inches in length as measured from the first end 361 to the second end 362. In some embodiments, the outer receiving tube 360 is between about 18 to 24 inches in length as measured from the first end 361 to the second end 362. In some embodiments, the outer receiving tube 360 is between about 24 to 36 inches in length as measured from the first end 361 to the second end 362.

In some embodiments, the outer receiving tube 360 is between about 3 to 6 inches in diameter. In some embodiments, the outer receiving tube 360 is between about 6 to 9 inches in diameter. In some embodiments, the outer receiving tube 360 is between about 9 to 12 inches in diameter.

In some embodiments, the inner receiving component 350 is between about 6 to 12 inches in length as measured from the first end 351 to the second end 352. In some embodiments, the inner receiving component 350 is between about 12 to 18 inches in length as measured from the first end 351 to the second end 352. In some embodiments, the inner receiving component 350 is between about 18 to 24 inches in length as measured from the first end 351 to the second end 352. In some embodiments, the inner receiving component 350 is between about 24 to 36 inches in length as measured from the first end 351 to the second end 352.

In some embodiments, the inner receiving component 350 is between about 3 to 6 inches in diameter. In some embodiments, the inner receiving component 350 is between about 6 to 9 inches in diameter. In some embodiments, the inner receiving component 350 is between about 9 to 12 inches in diameter.

The following the disclosures of the following U.S. Patents are incorporated in their entirety by reference herein: U.S. Pat. No. 5,217,320; U.S. Pat. Application No. 2007/0295520; U.S. Pat. No. 3,376,799; U.S. Pat. No. 3,308,730; U.S. Pat No. 4,601,352.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A compactor device for temporarily attaching to a shaft of a machine, said compactor device comprising:

(a) a generally flat base having a top surface and a bottom surface;

(b) an outer receiving tube having a first end and a second end, the second end being permanently attached to the top surface of the base via a reinforcing plate;

(c) an inner receiving component formed from a first half-pipe and a second half-pipe, wherein the inner receiving component has a first end and a second end and is removably disposed inside the outer receiving tube; wherein a diameter of the inner receiving component can be increased or decreased by moving the first half-pipe and the second half-pipe farther apart or closer together within the outer receiving tube; wherein the inner receiving component is for snugly gripping the shaft of the machine;

(d) a plurality of bolts traversing the outer receiving tube for securing the shaft inside the inner receiving component, wherein each bolt can be turned in a first direction or a second direction, wherein in the first direction the bolt moves toward the inner receiving component and puts pressure on the inner receiving component so as to compress the inner receiving component snugly against the shaft; wherein at least one set of bolts puts pressure on the first half-pipe, and wherein a different set of bolts puts pressure on the second half-pipe;

(e) a chain having a first end and a second end for securing the compacting device to the machine, wherein the second end of the chain is secured to the outer receiving tube via an attachment means and a safety hook is disposed on the first end of the chain, the safety hook being for clipping into a D-ring disposed on the machine;

wherein the compactor device is for compacting dirt, sand, or aggregate material.

2. The compacting device of claim 1, wherein the base has a first side edge, a second side edge, a third side edge, and a fourth side edge.

3. The compacting device of claim 2, wherein a first wall extends outwardly and upwardly from the first side edge of the base and is for helping to prevent debris from accumulating on the top surface of the base.

4. The compacting device of claim 2, wherein a second wall extends outwardly and upwardly from the second side edge of the base and is for helping to prevent debris from accumulating on the top surface of the base.

5. The compacting device of claim 1 further comprising one or more cross support components for providing support to the device.

* * * * *